United States Patent [19]

Crawshay et al.

[11] 3,951,216

[45] Apr. 20, 1976

[54] DIAMOND DRILL SUPPORTING APPARATUS

[75] Inventors: Richard Crawshay, North Vancouver; John Helmut Hradil, North Delta; Charles Duncan MacDonald, Delta, all of Canada

[73] Assignee: Canadian Mine Services Ltd., Vancouver, Canada

[22] Filed: Nov. 8, 1974

[21] Appl. No.: 522,035

[52] U.S. Cl. ..... 173/32; 173/28; 173/34; 173/36; 173/43; 173/156

[51] Int. Cl.[2] ..... E21B 1/02; E21B 5/00

[58] Field of Search ..... 173/32, 34, 36, 43, 173/28, 152, 156, 42; 175/171, 85; 248/16

[56] References Cited

UNITED STATES PATENTS

| | | | |
|---|---|---|---|
| 2,979,320 | 4/1961 | Adams | 173/34 X |
| 3,106,257 | 10/1963 | Helm | 173/34 X |
| 3,209,842 | 10/1965 | Meyer | 173/43 |
| 3,568,779 | 3/1971 | Cannon | 173/28 X |
| 3,708,020 | 1/1973 | Adamson | 173/152 X |
| 3,797,587 | 3/1974 | Klein | 173/152 |
| 3,809,344 | 5/1974 | Kolderup | 173/43 X |
| 3,835,940 | 9/1974 | Winter | 175/85 |

*Primary Examiner*—John E. Murtagh
*Assistant Examiner*—William F. Pate, III
*Attorney, Agent, or Firm*—Carver and Company

[57] ABSTRACT

Feed frame assembly for supporting and feeding drill head which rotates drill rod about axis. Assembly includes spaced front and rear end members, laterally spaced longitudinal members and first and second hydraulic feed cylinders. Longitudinal members and feed cylinders extend between end members and are parallel to rod axis. Piston rods of feed cylinders have double-acting pistons cooperating with cylinder bodies to feed head along the piston rods. Stabilizer cylinders in longitudinal members force bearing pads against rock face to counteract the drilling forces. Head mounting means secures rigidly one side of drill head to first cylinder body, and secures releasably with latch opposite side of head to second cylinder body. When latch is released drill head can swing outwards about first piston rod, and when engaged mutual actuation of feed cylinders moves drill head along rods. With head swung out, first cylinder is hydraulically locked to divert fluid to second cylinder. Pulling dog on second cylinder withdraws drill rods at twice normal speed as it receives twice fluid flow.

12 Claims, 12 Drawing Figures

DIAMOND DRILL SUPPORTING APPARATUS

BACKGROUND OF THE INVENTION

1. Field of the Invention

The invention relates to a drill supporting apparatus, in particular an apparatus for supporting a diamond drill head and a feed frame associated therewith.

2. Prior Art

Diamond drills have been used for many years for geological exploration and test drilling. Some types are powered by a machine having a drill head containing a screw feed mechanism, whilst other types utilize a powered head carried on a hydraulic feed unit. Either type may be attached to a skid or a bar mount which is secured adjacent to a rock surface at a drill station. Positioning and securing the machine in relation to the axis of the hole to be drilled can be difficult and time consuming, and failure to anchor the machine securely can result in misalignment problems which reduce machine performance and increase wear on drill rods etc., with consequent loss of drilling time and high maintenance costs.

When drilling in a confined space underground, the space available to insert drill rods into, or to withdraw drill rods from, a hole may be critical and is referred to as 'tail room'. If tail room can be increased, longer sections of rods can be removed or replaced with an accompanying saving of time. In some machines the drill head can be swung clear of the hole axis, thus increasing the tail room, and then a pulling dog can be fitted and aligned with the hole to remove or replace rods. The pulling dog is fed by an external air cylinder, winch means or sometimes the drill feed mechanism. It is known that conventional hydraulic feed mechanisms have feed speeds adequate only for actual drilling and are too slow for removing or replacing rods, particularly in deep holes. Each has its particular advantages but no device known to the inventors functions adequately and safely for all angles of bore holes.

Operation of diamond drilling machines can involve hazards; for instance when drilling upwards, the weight of the string of drill rods and the weight of water within the rods must be supported by the drill head chuck, or a drill rod locking device when the chuck is released. With some drill heads and drill rod locking devices, accidental loss of hydraulic pressure releases the chuck or rod lock gripping force, which can result in extreme danger to operators.

SUMMARY OF THE INVENTION

The present invention reduces some of the difficulties and disadvantages of the prior art by providing a drill supporting apparatus having a feed frame assembly in which a drill head thereof can be positioned to provide clearance for passing drill casings into the bore hole, without first requiring removal of the drill head, and also permits use of relatively long sections of drill rod. The apparatus also provides means for effecting rapid feeding of the drill rod into and from the drill hole using the same hydraulic fluid pump as is used for actuating the feed cylinders. Further the invention provides a versatile stabilizer arrangement in which reactions to drill forces imposed on the feed frame assembly are resisted by three or four fluid actuated stabilizer cylinders which are adapted to accommodate a wide range of terrain conditions. A rod lock assembly can be attached to the feed frame assembly to support the string of drill rods when drilling upwards or downwards. Jaws of the drill rod lock are opened and closed normally by a hydraulic cylinder, but are also spring-actuated to maintain grip on the rods in the event of hydraulic pressure failure. Further the feed frame assembly can be mounted on a drill supporting device which is carried on a skid arrangement supported on the ground or on a railway flat car.

A feed frame assembly according to the invention supports and feeds a drill head which has a drill head axis and is adapted to grip and rotate a drill rod about a drill rod axis concentric with the drill head axis. The assembly includes spaced front and rear end members, and a longitudinal means extending between the end members to secure the end members rigidly together. The assembly also includes first and second double rod hydraulic feed cylinders extending between the end members. The feed cylinders include first and second piston rods disposed parallel to the rod axis and having opposite ends, each end being secured to an adjacent end member, the piston rods having double-acting pistons. The feed cylinders also include first and second hydraulic cylinder bodied cooperating with the respective rods and pistons, the bodies being adapted to communicate with a hydraulic power means for moving the cylinder bodies along the respective piston rods. First and second drill head mounting means are adapted to secure the drill head to the first and second cylinder bodies. The first mounting means rigidly connects the drill head to the first cylinder body to permit swinging of the drill head with the first cylinder body about the first piston rod so that the drill head axis can be swung away from the drill rod axis to a non-aligned position to provide clearance. The first piston rod thus serves as a hinge pin for the drill head. The second mounting means includes a connecting means adapted to secure releasably the drill head to the second cylinder body so that the drill head and drill rod axes are aligned, so that mutual actuation of the feed cylinders moves the drill head along the piston rods.

The invention also provides an apparatus for supporting the feed frame assembly, including a swivel base having first and second mutually rotatable base members. The first base member is rotatable about a first axis thereof, and the second bast member is adapted to be mounted on a supporting device.

The supporting apparatus also includes a frame bed secured to the first base member, the frame bed having track means disposed parallel to the drill rod axis. The longitudinal means include a slide means extending between the end members of the feed frame assembly, which slide means cooperates with the track means to permit sliding of the feed frame assembly relative to the frame bed. The supporting apparatus also includes a positioning cylinder extending between the frame bed and the feed frame assembly so that actuation of the positioning cylinder slides the frame assembly relative to the frame bed to permit positioning of the feed assembly relative to the rock face. Locking means are provided adjacent the track means to lock the feed frame assembly rigidly to the frame bed when the feed frame is positioned in the desired location.

A detailed disclosure following, related to drawings, describes a preferred embodiment of the invention which is capable of expresion in structure other than that particularly described and illustrated.

DETAILED DISCLOSURE

Figures 1, 2, 3, 4:
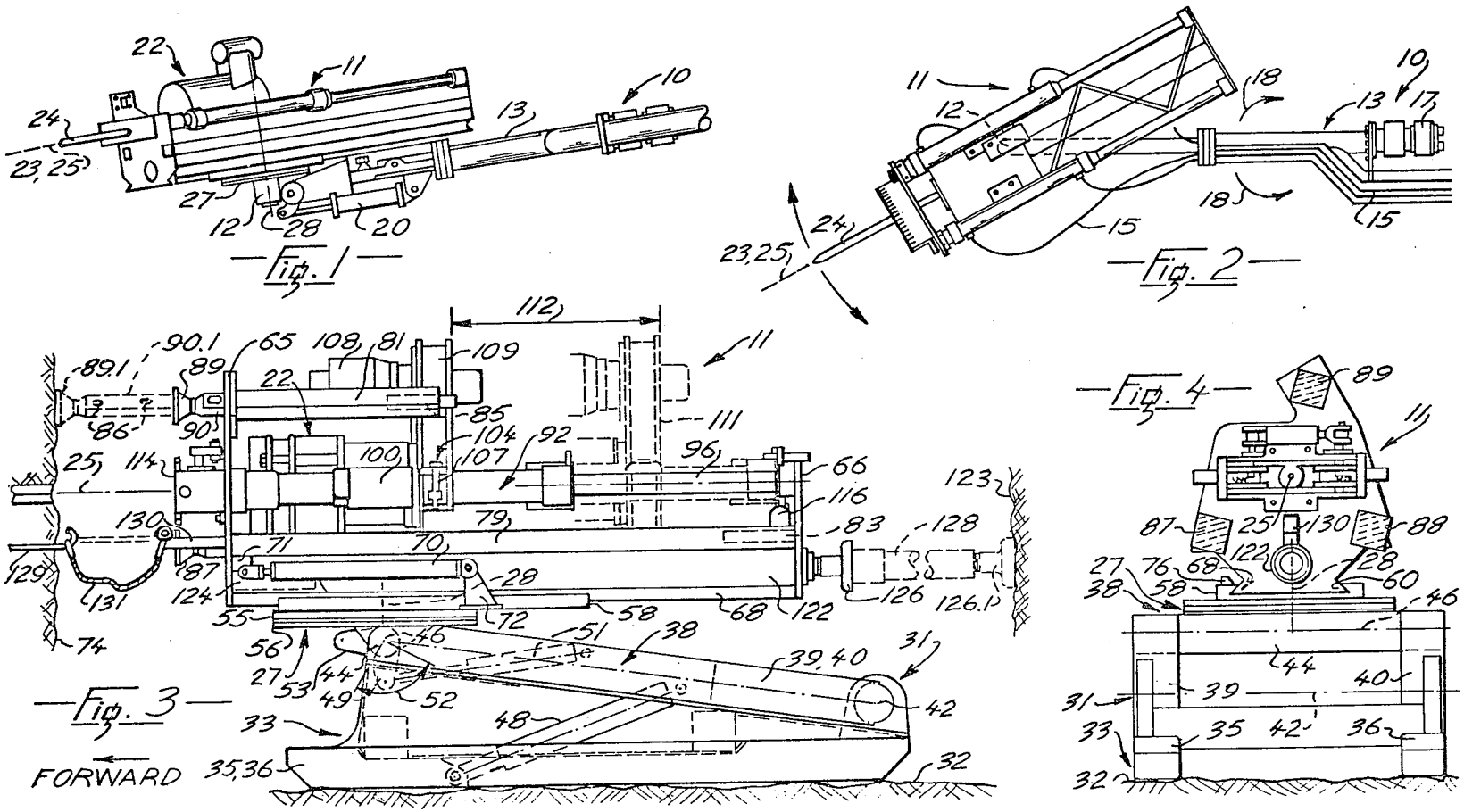
FIG. 1 is a simplified fragmented side elevation of a feed frame assembly according to the invention fitted to an end of an extensible rotatable boom type drill mount.
FIG. 2 is a simplified fragmented top plan view of the mount of FIG. 1.
FIG. 3 is a fragmented, simplified side elevation of the feed frame assembly of FIG. 1 shown mounted on a skid type drill mount, portions of adjacent rock faces and fore and aft positions of a drill head being shown in which drill rod and drill head axes are aligned.
FIG. 4 is a simplified front elevation of the structure of FIG. 3, some hydraulic cylinders not shown.

FIGS. 1 and 2

A boom type drill mount 10 includes a feed frame assembly 11 according to the invention mounted at an outer end 12 of a boom 13. The boom 13 extends from a self-propelled, track-laying or wheeled vehicle (not shown) and can be swung relative to the vehicle to position the end 12 where required. Hydraulic hoses 15 extend from control valves in the vehicle to appropriate hydraulic cylinders in the feed frame 11 as will be described. A rotary actuator 17 rotates the feed frame about a longitudinal axis of the boom, as shown by arrows 18. A hydraulic cylinder 20 which cooperates with the boom and the feed frame tilts the feed frame relative to the boom. The feed frame assembly is supported on a swivel base 27 so that the assembly 11 can be rotated about a first or yaw axis 28. The frame is thus mounted for relatively universal movement of the feed frame, similarly to prior art boom supported percussive rock drilling rigs.

The feed frame supports and feeds a drill head 22 having a drill head axis 23, the head being adapted to grip a drill rod 24 and rotate the drill rod about a drill rod axis 25. The vehicle, the boom 13 and associated structure cooperating with the swivel base on a side of the swivel base remote from the feed frame assembly serve as one type of supporting device for the feed assembly. This is generally similar to the prior art percussive rock drill rigs and forms no part of the invention. An alternative and novel supporting device is to be described with reference to FIGS. 3 and 4, which device, together with the feed frame 11, forms the main portion of the invention.

FIGS. 3 through 6

In all figures to be described, most hydraulic hoses extending between the cylinders, valves, pumps, etc., have been omitted for clarity. The swivel base 27 mounts the feed frame 11 and extends from a skid type drill mount 31 resting on the ground 32, but alternatively the skid could be fitted with wheels for running on rails. The mount 31 is an alternative supporting device and includes a skid base 33 adapted to be supported horizontally and having a pair of spaced parallel ground bearing runners or skids 35 and 36. A support arm 38 has a pair of similar spaced parallel arm members 39 and 40 hinged to the skid base for swinging of the support arm about a lower hinge axis 42. An outer end of the support arm carries a spindle 44 which hinges the support arm to the swivel base 27 for swinging of the swivel base about an upper hinge axis concentric with the spindle 44, the axes 46 and 42 being parallel. Two jacking cylinders, one only being shown designated 48, extend between the skid base and the support arm for swinging the support arm about the lower hinge axis 42 to raise or lower the feed frame assembly. A bracket 49 extends downwards from the spindle 44 to a lower end thereof, and a tilting cylinder 51 is releasably connected thereto to extend between the bracket 49 and the support arm 38. Thus actuation of the tilting cylinder 51 swings the swivel base about the axis 46 through an arc 52 of about 90 degrees, thus tilting the feed frame assembly 11 in a fore and aft pitching motion. A second bracket 53 extends forwards from the spindle 44 and is disposed at approximately 90° to the bracket 49. A second tilting cylinder, not shown, extends from the support arm 38 similarly to the cylinder 51 and, when fully extended, can be connected releasably to the bracket 53 when the cylinder 51 is fully retracted. When so connected, the first cylinder 51 is disconnected and retraction of the second tilting cylinder swings the feed frame through a second arc, not shown, also of about 90°. Thus, the two tilting cylinders individually can swing the feed frame relative to the arm 38 through an arc approaching 180°. Thus the tilting cylinders cooperate with the swivel base and the support arm so that actuation of the tilting cylinders swings the swivel base, and with it the feed frame assembly 11, about the upper axis 46. Such movement permits drilling at essentially any angle.

The feed frame assembly can also be rotated about the first axis 28 by means of the swivel base 27, which includes first and second mutually rotatable swivel base members 55 and 56, the members being journalled by a thrust bearing concentric with the axis 28. The swivel base is rotated and locked manually thus positioning the feed frame. The second base member 56 is mounted on the spindle 44 and thus couples the swivel base to the supporting device. A frame bed 58 is secured to the first base member 55, the bed having a dove-tail sectioned groove 60 extending along an upper surface thereof and disposed parallel to the drill rod axis.

The feed frame assembly includes spaced front and rear end members 65 and 66 positioned at front and rear ends of the assembly. A slide means 68 extends between the end members and is a major structural member of the assembly and serves as a longitudinal means securing the end members rigidly together. The slide means 68 has a dove-tail sectioned tongue portion complementary to the groove 60 and thus engages the groove 60 for sliding of the feed assembly relative to the frame bed. Thus the dove-tail sectioned groove serves as a track means which cooperates with the slide means of the feed frame for longitudinal positioning of feed frame relative to the swivel base. A positioning cylinder 70 extends between a bracket 71 secured to the feed frame assembly and a bracket 72 secured to the frame bed. Actuation of the positioning cylinder slides the feed frame relative to the frame bed to permit positioning of the feed assembly relative to a rock face 74 adjacent the front end of the feed frame assembly. Locking means 76, for instance a manually operated pinch bolt device, is provided on the track means and adjacent the slide means to lock the feed frame assembly rigidly to the frame bed when the feed frame is positioned in a desired location. Thus rotation of the assembly about the axes 42 and 46 by the jacking and tilting cylinders 48 and 51 and about the axis 28 by the swivel base 27, and axial sliding by the positioning cylinder 70 on the track and slide means provide an essentially universal mounting for the feed frame. The drill can be easily positioned where required, at the height and inclination to the horizontal required, and pointed in a direction within a horizontal plane as required.

Figure 6:
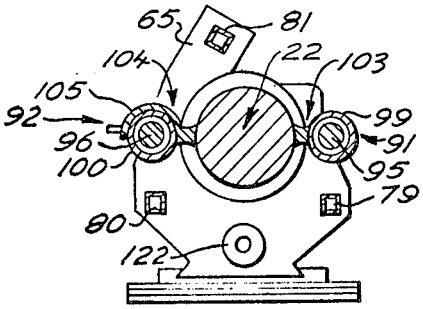
FIG. 6 is a simplified section on 6—6 of FIG. 5 showing relative positions of major portions of the feed frame apparatus.
Figure 7:
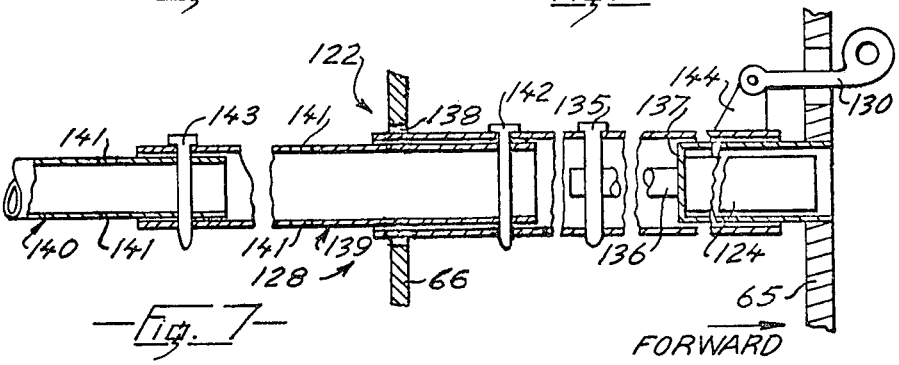
FIG. 7 is a simplified fragmented view of portions of a rear stabilizer means.

The feed frame assembly includes first and second laterally spaced longitudinal members 79 and 80 disposed parallel to the drill rod axis and extending between the end members 65 and 66. The members 79 and 80 are also structural longitudinal means connecting the end members and for clarity the second member 80 is omitted in FIG. 3. A third longitudinal member 81 extends rearwards from the front end member 65 and is disposed parallel to the drill rod axis, and, as best seen in FIG. 6, is positioned on a side of the drill rod axis 25 generally remote from the members 79 and 80 so that the three longitudinal members are spaced generally symmetrically about the rod axis. The members 79, 80 and 81 are hollow and square-sectioned and include first, second and third stabilizer cylinders 83 through 85 respectively fitted within the respective hollow members, the cylinders cooperating with first, second and third bearing pads 87 through 89 respectively at front end of the longitudinal members. Each stabilizer cylinder has a piston rod coupled by a pin (not shown) to an inner leg complementary to the longitudinal member, one such leg 90 of the third member 81 being shown in two positions. The stabilizer cylinder 85 is adapted to extend the bearing pad 89 and the leg 90 forward from a retracted position, shown in full outline, to extended positions 89.1 and 90.1 shown in broken outline, so as to bring the bearing pad into contact with the rock face 74. The leg 90 has a plurality of aligned openings 86 to accept the pin journalling the end of the piston rod so as to permit repositioning of the piston rod relative to the inner leg. An example of a similar releasable connection is shown in FIG. 7. Inner legs 93 and 94 extending from the members 79 and 80 respectively are similarly releasably coupled to the stabilizer cylinders 83 and 84 respectively. All three inner legs are thus easily adjustable relative to the respective piston rods, such adjustment increasing range of accommodation of the pads to conform to the rock face 74.

First and second double rod hydraulic feed cylinders 91 and 92 extend between the end members 65 and 66 and include first and second piston rods 95 and 96 disposed parallel to the rod axis and having opposite ends secured to an adjacent end member. The piston rods have double-acting pistons and are fitted within first and second hydraulic cylinder bodies 99 and 100, the bodies having intake ports (not shown) adapted to communicate with a hydraulic power means (not shown) for moving the cylinder bodies along the respective piston rod.

Figure 5:
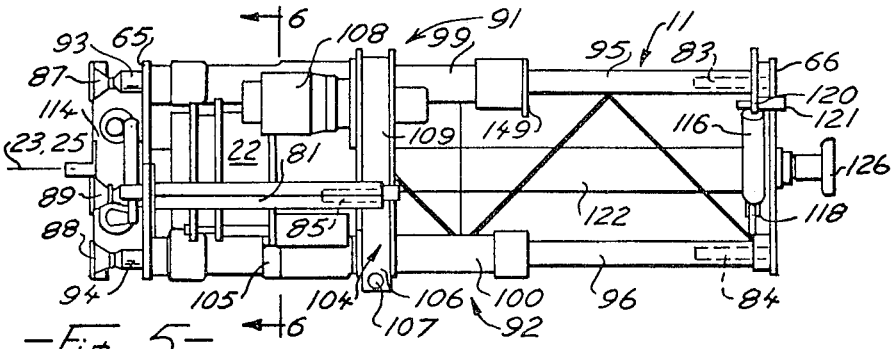
FIG. 5 is a simplified top plan showing basic components of the feed frame assembly, in which the drill head is at a forward end of the frame assembly, and the drill head and drill rod axes are aligned.

With reference to FIGS. 5 and 6, first and second drill head mounting means 103 and 104 are secured to the first and second cylinder bodies. The means 103 rigidly connects one side of the drill head to the first cylinder body 99 so that there is no relative motion between the body and the drill head. The second mounting means 104 secures releasably the opposite side of the drill head to the second cylinder body to permit swinging of the drill head as will be described. The second mounting means 104 includes a pair of spaced arcuate lugs 105 and 106 secured to and extending outwards from the drill head, which lugs, when secured by a releasable latch means 107, rigidly lock the drill head to the second cylinder. The latch means can be a screw, cam type or other connecting means which can be quickly released or engaged. When the arcuate lugs engage the second cylinder body, the drill head axis 23 and drill rod axis 25 are aligned so that mutual actuation of the feed cylinders moves the drill head along the piston rods. Referring to FIG. 3 only, the feed cylinders 91 and 92 and the drill head are shown at a forwardmost position adjacent the front end member 65, and in broken outline in a rearmost position, designated 111, space between the two positions representing a maximum stroke 112 of the drill head, in this particular instance about 30 inches. The drill head is powered by a motor 108 extending from a transmission housing 109, means, not shown, within the housing powering the drill head.

A drill rod lock 114 is secured to the front end member 65, the drill rod passing therethrough, similarly to prior art drill rod locks. The rod lock is to be described in greater detail with reference to FIGS. 10 through 12. A head swing-out cylinder 116 is provided adjacent the rear end member 66 and has one end connected to a bracket 118 secured to the assembly adjacent the end member, and an opposite end 120 adapted to cooperate releasably with means connected to the drill head as will be described with reference to FIG. 9. An indexing pin 121 connects the cylinder 116 when required to the cylinder body 99 for swinging-out the drill head, as will be described with reference to FIGS. 8 and 9.

A fourth hollow longitudinal member 122 extends between the front and rear members 65 and 66 and cooperates with a fourth stabilizer cylinder 124 for use when a second rock face 123 is adjacent the rear end of the frame assembly. The fourth member 122 cooperates with a fourth bearing pad 126 which is adapted to extend rearwards from a retracted position to contact the second rock face 123, to apply a force in opposition to forces from the stablizer cylinders 83 through 85. The cylinder 124 cooperates with a plurality of telescopic sections 128, shown in broken outline, which by repositioning of the sections as will be described with reference to FIG. 7, can extend the bearing pad 126 to an extended position 126.1 When the drill supporting apparatus is used in a confined space with opposing rock faces 74 and 123, the first, second and third bearing pads are in intimate contact with the face 74, and oppose force from the fourth stabilizer cylinder. The four stabilizer cylinders communicate with a manual pump and valve means (not shown) which selectively directs fluid as required. Thus the feed frame assembly is in equilibrium and is held rigidly between the first and second rock faces, maintaining alignment as drilling proceeds. Note that the fourth longitudinal member is spaced as closely as is practical to a triangle formed by the three pads 79, 80 and 81, thus reducing a tendency of the assembly to pitch due to a couple resulting from opposed forces.

Alternatively, if the device is positioned adjacent only the face 74, and the fourth bearing pad 126 cannot be used, an anchor bolt 129 is fitted in the rock face 74 adjacent the front end member 65. By means to be described with reference to FIG. 7, an attachment means 130 cooperates with the fourth stabilizing cylinder so that actuation of the fourth cylinder moves the attachment means in a direction parallel to the drill rod axis. A flexible coupling 131 extends between the anchor bolt 129 and the attachment means 130 and, provided there is only little slack in the coupling 131, when the first, second and third stabilizer cylinders are extended so that the associated bearing pads are forced against the rock face 74, actuation of the fourth stabilizing cylinder draws the attachment means 130 away from the face 74 thus drawing the coupling 131 taut. Thus tension in the coupling means 131 is opposed by reaction forces generated by the first, second and third stabilizing cylinders. It is usual to set the pads 87, 88 and 89 in correct positions on the face to attain desired drill alignment and then extend the fourth stabilizer cylinder 124 to take up slack in the coupling means 131, provided limit of extension of the cylinder is not reached.

In a second alternative, the attachment means 130 can be attached to the front end member 65, and thus is independent of the fourth stabilizer cylinder. In such a position the slack in the coupling 131 is taken up by the three cylinders 83, 84 and 85 and thus there is likely to be difficulty in maintaining the drill in alignment. Thus the coupling means should be fitted with relatively little slack with the stabilizer cylinders almost retracted and the bearing pads in intimate contact with the rock face 74. The cylinders are extended equally and, before the cylinders reach the limits of extension, all slack is removed and sufficient force is applied to hold the feed assembly rigidly against the rock.

In the first and second alternatives above the attachment means 130 is positioned to be within the triangle formed by the three bearing pads as seen in FIG. 4, so that tensile force on the means 130 does not create an undesirable couple tending to tilt the feed frame assembly out of alignment.

FIG. 7

The fourth hollow longitudinal member 122 is connected by a pin 135 to a piston rod 136 of the stabilizer cylinder 124, the cylinder being housed within an anchoring pipe 137. An end of the member 122 adjacent the member 65 is carried by the anchoring pipe 137 and at the opposite end is a sliding fit in an opening 138 in the member 66. The anchoring pipe 137 has an open forward end secured to a sidewall of an opening in the front end member 65 to provide easy access to the cylinder 124. The telescopic sections 128 include interfitting second and third pipes 139 and 140, both pipes including a plurality of aligned openings 141 to accept respective pins 142 and 143 which connect adjacent pipes together as shown. The fourth bearing pad 126 (FIGS. 3 and 5 only) is fitted at an aft end of the pipe 140 and, by selection of particular openings 141, a desired extension of the member 122 can be attained which is sufficient, with a relatively small stroke of the cylinder 124 to force the pad 126 against the adjacent wall. The attachment means 130 is hinged to a bracket 144 extending upwards from a forward end of the member 122 to be within the triangle formed by bearing pads of the three longitudinal members as aforesaid. The stabilizer cylinders 83, 84 and 85 (FIG. 5) similarly cooperate with respective inner legs.

Figure 8:
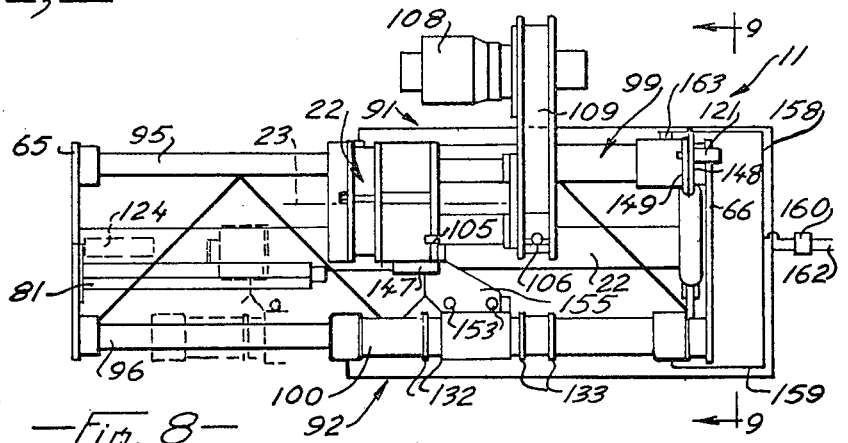
FIG. 8 is a simplified top plan of the feed frame assembly in which the drill head has been swung outwards to be clear of the drill rod axis to a non-aligned position, a portion of a hydraulic schematic also being shown.
Figure 9:
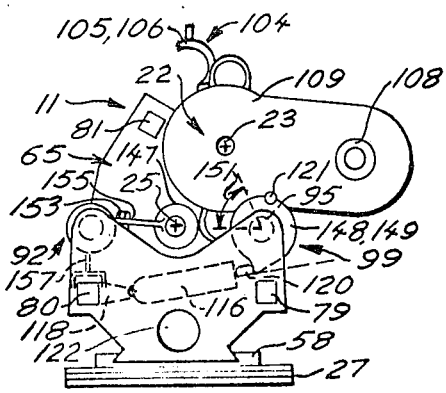
FIG. 9 is a simplified rear elevation of the apparatus as seen from 9—9 of FIG. 8.

FIGS. 8 and 9

In these figures bearing pads, rod lock means, drill rod lock means and other structures have been omitted for clarity. The drill head assembly and feed cylinders are shown at the rearmost position 111, with the drill head swung out of alignment about a piston rod to a non-aligned position. This improves clearance for drill casings and longer sections of drill rod to be passed into the bore hole without having first to pass through the drill head, thus contrasting with some prior art drills. This procedure also permits use of a pulling dog 147 releasably connected to a feed cylinder for inserting drill rods into, and withdrawing drill rods from, the bore hole as will be described, and also facilitates maintenance of the drill head.

To swing the drill head from aligned position as shown in FIG. 5 to the non-aligned position as shown in FIG. 9, the feed assembly is first actuated so that the drill head is moved to the rearmost position as shown in FIG. 8. The latch means 107 (FIG. 5) is disconnected so as to free the drill head from the second cylinder body 100. A rotary connector 148 adjacent the end member 66 is journalled for rotation about an axis concentric with the piston rod 95. The connector 148 is hinged to the end 120 of the cylinder 116 and carries the indexing pin 121. The indexing pin 121 extends forwards from the rotary connector and is engaged in an aligned opening in a bracket 149 secured against rotation to a rearmost end of the cylinder body 99. If the pin is fitted permanently in the rotary connector the pin can be spring-loaded to reduce impact damage that might occur whilst attempting to align the pin with the opening. Alternatively the pin can be manually inserted through aligned openings in the connector 148 and the bracket 149. When the pin is fitted the end 120 of the cylinder 116 is coupled to the cylinder body 99 which is rigidly connected to the drill head. As seen in FIG. 9, retraction of the cylinder 116 rotates the first cylinder body 99 about the piston rod 95 to swing the drill head 22 and transmission housing 109 through an arc 151, approximately 60°, so that the drill head assumes the non-aligned position in which the drill head axis has moved laterally relative to the rod axis. Note that hinging the drill head on the first piston rod which thus serves as a hinge pin, simplifies prior art structure for swinging the drill head, and furthermore results in the second cylinder being free of the first cylinder for independent movement. This is of major importance for increased clearance for passing drill casings and a simplified rod pulling structure as will be described.

The second cylinder body has pulling dog lugs 153 attached thereto, the lugs engaging complementary openings in a dog bracket 155 carrying the dog 147 at an outer end thereof. Thus the pulling dog is releasably secured to the feed cylinder 92, so that an axis of the pulling dog can be aligned with the drill rod axis 25.

The dog is a conventional rod pulling dog which grips drill rods for withdrawing the drill rods from the hole and can be reversed for feeding rods into the hole and thus does not require further description. Actuation of the second feed cylinder 92 from the forward position to a rearward position slides the pulling dog rearwards, and thus permits power withdrawal of the drill rod from a bore hole. A dog guide 157, shown in broken line in FIG. 9 only, extends downwards from the body 100 to engage the member 80 for lateral sliding. This prevents rotation of the cylinder body 100 arising from the unsupported weight of the dog 147, thus ensuring that the dog is maintained aligned with the axis 25.

Hydraulic line pairs 158 and 159 extend to the feed cylinders from a main valve means 160, the valve means being connected through a further line pair 162 to the hydraulic power means (not shown). A manual locking valve 163 is fitted at a rearmost port of the cylinder 91, and when closed, provides a hydraulic lock to prevent movement of the cylinder 91 and also directs fluid to the cylinder 92. The valve means 160 is a manually operable three-position, four-way fluid valve. In a first position with the valve 163 open, the valve 160 directs fluid to both feed cylinders so that the drill head assembly advances; in the second position it directs fluid so that the assembly retracts and in the third position the drill head assembly is stationary. When the valve 163 is closed, fluid is diverted from the first cylinder to the second cylinder for advancing or retracting the second cylinder only, independently of the first cylinder. Thus, when the valve 163 is closed the second feed cylinder receives both fluid flows, thus permitting more rapid actuation of the second feed cylinder to increase speed of withdrawal of the drill rod from the bore hole. Thus the speed of actuation of the second cylinder is doubled without requiring a change in flow delivery of the pump. Because the valve 163 isolates the cylinder 91, the cylinder 91 is hydraulically locked against creep and thus drill head movement is restricted irrespective of inclination of the feed frame to the horizontal.

The second drill head mounting means 104 also includes on the cylinder body 100 a pair of spaced ridges 132 to accept the arcuate lug 105 and a similar pair of spaced ridges 133 to accept the arcuate lug 106. The ridges thus provide shoulder means complementary to the arcuate lugs and, when the lugs are secured rigidly to the second cylinder body by the latch means 107 (FIG. 5 only) concurrent movement of both feed cylinders and the drill head is ensured.

Figures 10, 11, 12:
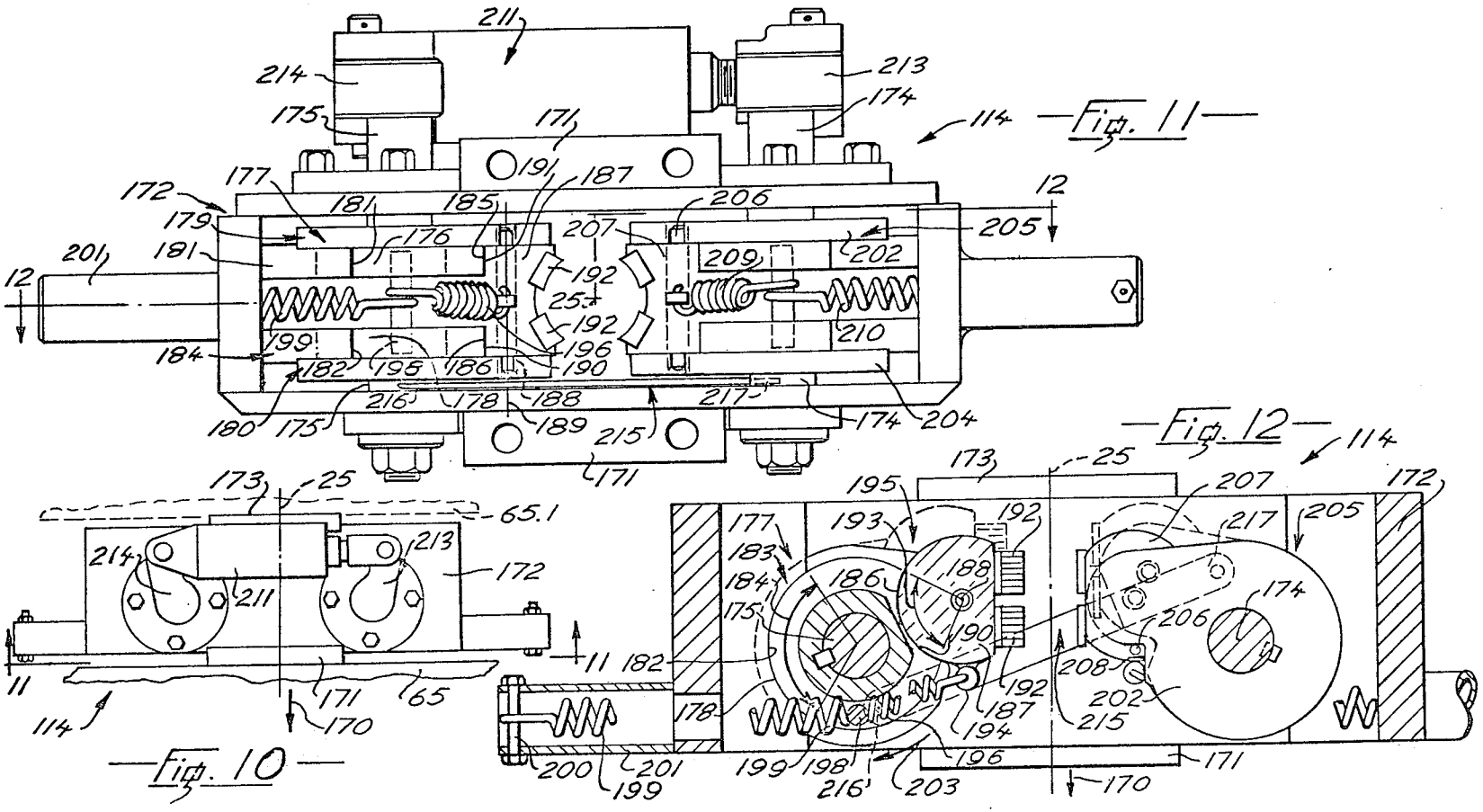
FIG. 10 is a fragmented top plan of a drill rod lock means fitted to a front portion of the apparatus.
FIG. 11 is a simplified elevation of the rod lock, as seen from 11—11 of FIG. 10.
FIG. 12 is a simplified fragmented section on 12—12 of FIG. 11.

FIGS. 10 through 12

The drill rod lock 114 has a housing 172 which straddles the drill rod axis 25 so that the drill rods can pass therethrough. The housing has pairs of spaced mounting lugs 171 and 173 for connection of the housing to the end member 65 in either of two positions to be described.

The lugs 171 can be fitted adjacent to the front end members 65 of the feed frame assembly as shown in full outline in FIG. 10 so as to prevent drill rods falling into the drill head in direction of an arrow 170, for instance when drilling upwards. Alternatively, when the rod lock 114 is reversed through 180° and mounted so that the lugs 173 are adjacent the front end member, shown in broken line as 65.1, the rod lock prevents drill rods falling downwards away from the drill head, as when drilling downwards.

The rod lock 114 includes a pair of spaced parallel pivot pins 174 and 175 journalled in the housing and disposed on opposite sides of the drill rod axis in planes normal to the drill rod axis. A jaw holder 177 is secured to the pin 175 by key means, and includes a pair of spaced flanges 179 and 180 having an outer faces thereof convex partially cylindrical shoulders 176 and 178 respectively. The shoulders contact complementary concave partially cylindrical surfaces 181 and 182 of the housing, the shoulders and surfaces being concentric with the pivot pin 175. The surfaces 181 and 182 support the respective shoulders therein and thus serve as bearing seats which are disposed on a side of the pivot pin remote from the rod lock axis and are adapted to support reactions from gripping the drill rods as will be described. The seats extend over an arc 184, about 110°, and thus provide an outer bearing 183 of considerable area.

A jaw member 187 is hinged to the jaw holder by a jaw pin 188 passing through inner ends of the flanges 179 and 180, so that the jaw member can rotate about a jaw axis 189 parallel to the pivot pin. The jaw member 187 has an outer surface having a pair of convex partially cylindrical bearing surfaces 185 and 186 concentric with the jaw pin 188. The jaw holder 177 has a pair of concave partially cylindrical bearing surfaces 190 and 191 concentric with the jaw pin 188 and complementary to and adapted to support the bearing surfaces 186 and 185 of the jaw member 187. Thus the concave bearing surfaces 190 and 191 serve as bearing seats and extend over an arc 193, about 100°, thus providing a relatively large inner bearing 195. The jaw member 187 has an inner surface disposed diametrically opposite to the outer surface thereof having a pair of inserted jaw teeth 192, suitable of hardened material such as tungsten carbide, thus serving as a jaw face to contact the drill rod.

One end of an inner spring 196 is retained on a lug 194 extending from the jaw member 187, and an opposite end of the spring engages an anchor pin 198 extending between the flanges 179 and 180. An outer spring 199 has an inner end cooperating with the anchor pin 198 and an outer end secured to an anchor bolt 200 fitted in tube 201 extending from the housing. As can be seen, the springs serve as spring means cooperating with the jaw member, to swing the jaw members inwards towards the drill rod axis 25 in direction of arrow 203.

On an opposite side of the axis 25, a jaw holder 205 having flanges 202 and 204, cooperates with a jaw member 207. The holder rotates with the pivot pin 174 due to force from inner and outer springs 209 and 210, all structure being a mirror image of the corresponding structure opposite. A stop 206 extends from the jaw member 207 and limits rotation of the member relative to the jaw holder 205 due to the spring 209 by interfering with a shoulder 208 in the flange 202. This prevents the jaw member 207 from rotating excessively to a position nonaligned with sides of the drill rod. The jaw member 187 on the opposite side is similarly limited by a stop, not shown. The jaw member of one jaw holder is thus disposed oppositely to the jaw member of the opposite holder and spaced equally from the drill rod axis. Both spring means cooperate with the jaw members to swing the jaw members inwards toward each other so that the jaw members can grip a drill rod (not shown) positioned between the jaw members. Note that by hinging the jaw members 187 and 207 for rotation relatively independently of the position the jaw holders, the jaw teeth are self-aligning so that both teeth of each jaw member on opposite sides can engage sides of a drill rod. Different size jaw members can be fitted so that the rod lock can easily accommodate a relatively wide range of rod diameters.

An actuating cylinder 211 is hinged to lever arms 213 and 214 extending from the pivot pins 174 and 175 respectively. Thus the cylinder 211 cooperates with each pivot pin so that actuation of the cylinder rotates the pivot pins. The cylinder is arranged so that extension of the cylinder rotates the pivot pins so as to swing the jaw holders outwards to outer positions shown in broken outline in FIG. 12. Thus extension of the cylinder 211 is adapted to release a drill rod retained in the jaws. Conversely retraction of the cylinder swings the pivot pins so as to cause the jaws to grip the rod, thus augmenting gripping face from the spring means. Note that weight of the drill rods acting in the direction of the arrow 170 generates a gripping force on the jaws by a toggle action, which also augments gripping due to the spring and cylinder. Note that gripping is initiated by the actuation of the cylinder 211 as above and also, to a lesser extent, by the springs as can be seen in FIG. 12. When drilling vertically with a long string of drill rods, a considerable gripping force can be generated due to this toggle action. The cylinder 211 is positioned so that force available to open the jaws is greater than force available to close the jaws, that is maximum piston area is used in the extending mode, which might be required to break the excessive gripping force or lock resulting from the toggle action above. A link 215 has ends 216 and 217 hinged to the jaw holders 177 and 205 respectively, synchronizing movement of the holders to ensure centralization of the drill rod between the jaws.

As can be seen, the jaw members, the jaw holders and the housing 172 are subjected to considerable outwards forces resulting from the toggle action as described above. The pivot pins 174 and 175 and jaw pins have relatively small diameters and would clearly wear rapidly if all the forces were to be borne by them alone. The rod lock is designed so that majority of these forces is borne by the relatively large bearing areas of the inner and outer bearings 195 and 183 respectively. Thus most of the reaction from the gripping force of the jaws is transferred from the jaw members, across the inner bearings into the jaw holder and then from the jaw holder across the outer bearing to the housing, thus reducing loads on the jaw pins and pivot pins. Hydraulic hoses (not shown) extending to the actuating cylinder 211 permit remote release or gripping of drill rods by the jaws of the drill rod lock. Note that if there were a hydraulic pressure failure, force from the spring means would cause the jaw members to maintain grip on the drill rod, and thus reduce danger to operators.

Other types of drill rod locks can be substituted and secured to the front end member in a similar manner.

OPERATION

Referring to FIGS. 1 and 2, the boom 13 carrying the feed frame assembly 10 is controlled for relatively coarse adjustment from the vehicle (not shown) after which fine adjustment is accommodated by the feed apparatus. The cylinder 20, which controls inclination of the assembly 11 relative to the boom and is equivalent generally to the cylinders 51 of FIG. 3, is actuated to change angle of inclination of the drill rod axis to the horizontal. The swivel base 27 is rotated manually prior to raising the boom, and this permits positioning of the drill in a plane normal to the first axis 28. When the drill is correctly positioned, the stabilizer cylinders are extended as required to hold the feed frame assembly rigidly against drill forces. As drilling proceeds the drill head and feed cylinders traverse the piston rods for use as in a normal drilling operation.

With reference to FIGS. 3 through 9, the skid type drill mount 31 is positioned with the front end thereof adjacent a rock face where a bore hold is to be drilled. The jacking cylinders and the tilting cylinders are actuated so that the feed frame assembly 11 attains a desired height and inclination relative to the ground 32. The swivel base 27 is unlocked and rotated by hand so that the drill rod axis is disposed at a desired angle in the plane normal to the axis 28. If the rock face 123 is adjacent the rear end member 66, there is no requirement for the anchor bolt 129. Thus the first, second and third bearing pads are positioned adjacent the rock face 74 by extension of respective stabilizer cylinders, and the fourth stabilizer cylinder is actuated so that, through the telescoping sections 128, the bearing pad 126 is forced against the face 123. Thus the three bearing pads at the front end resist the force from the fourth pad, and locate the assembly rigidly for drilling.

If the rock race 123 is not sufficiently close to the rear end of the assembly, a separate short bore hole for the anchor bolt 129 is drilled, and the coupling means 131 attached to extend between the bolt and the attachment means 130. The four stabilizer cylinders are extended to draw the coupling means 131 taut so that the drill apparatus is clamped rigidly against the face 74.

Drill rods can be inserted and drilling commenced, the drill being advanced by feeding the feed cylinders forwards along the piston rods. At the end of the stroke, the drill rod stops and is gripped by the rod lock, the chuck jaws release the drill rod, the valve means 160 is reversed, and the drill head and cylinder bodies are traversed back towards the rear end member 66. The chuck jaws grip the rod and the process is repeated as in normal drilling. If a casing is to inserted in the bore hole, the drill head is fed to the rearmost position, the latch means 107 is released manually, thus freeing one side of the drill head, and the indexing pin 121 is engaged to couple the feed cylinder 91 to the swing-out cylinder 116. The cylinder 116 is actuated so that the transmission housing and drill head swing to assume the non-aligned position shown in FIG. 9. The casing can be then inserted in the bore hole as required, without passing though the drill head.

If it is required to withdraw drill rods from, or insert drill rods into the bore hole, the drill head is swung out as above and the dog 147 and associated bracket 155 are fitted on the lugs 153 of the second cylinder. The manual locking valve 163 is closed, thus sealing off the first cylinder 91. The cylinder 92 is then traversed forward so that the dog encloses the drill rod to be drawn from the hole. The valve means 160 is actuated to reverse flow to the cylinder 92 which withdraws the rod from the hole. Speed of actuation of the cylinder 92 is twice the normal speed as the feed cylinder 92 now receives twice as much fluid.

We claim:

1. A feed frame assembly for supporting and feeding a drill head, the drill head having a drill head axis and being adapted to grip and rotate a drill rod about a drill rod axis aligned with the drill head axis, the assembly including:

i. spaced front and rear end members, ii. longitudinal means extending between the end members to secure the end members rigidly together, iii. first and second double rod hydraulic feed cylinders extending between the end members, the feed cylinders including:

a. first and second piston rods disposed parallel to the rod axis and having opposite ends, each end being secured to an adjacent end member, the piston rods having double-acting pistons, b. first and second hydraulic cylinder bodies cooperating with the respective piston rods and pistons, the bodies being adapted to communicate with a hydraulic power means for moving the cylinder bodies along the respective piston rods, the first cylinder body being journalled for rotation on the first piston rod, c. first and second drill head mounting means adapted to secure generally opposite sides of the drill head to the first and second cylinder bodies, the first drill head mounting means rigidly connecting the drill head to the first cylinder body to permit swinging of the drill head with the first cylinder body about the first piston rod, the first piston rod thus serving as a hinge pin to permit the drill head axis to be swung away from the drill rod axis to a non-aligned position to provide clearance; the second drill head mounting means including a connecting means adapted to secure releasably the drill head to the second cylinder body so that the drill head and drill rod axes are aligned, so that mutual actuation of the feed cylinders moves the drill head along the piston rods.

2. A feed frame assembly as claimed in claim 1 in which the frame assembly is adapted to be used in conjunction with an anchor bolt in a first rock face adjacent the front end of the assembly, the feed frame assembly including:

i. an attachment means fitted adjacent the front end of the assembly, the attachment means being adapted to be coupled to the anchor bolt, and in which the longitudinal means includes:

ii. laterally spaced first and second hollow longitudinal members disposed parallel to the drill rod axis, iii. first and second stabiliser cylinders fitted within the first and second longitudinal members respectively, the cylinders cooperating with bearing pads at front ends thereof and being adapted to extend the respective bearing pads forward from a retracted position to force the pads against the rock face, thus tending to force the feed frame assembly away from the rock face, the frame assembly further including:

iv. a third hollow longitudinal member extending rearwards from the front end member and disposed parallel to the drill rod axis and on a side of the drill rod axis generally remote from the first and second longitudinal members, so that the three longitudinal members are spaced generally symmetrically about the rod axis, the third longitudinal member also including:

v. a third stabilizer cylinder fitted within the third longitudinal member and cooperating with a third bearing pad at a front end thereof, the third cylinder being adapted to extend the third bearing pad forward from a retracted position to force the third bearing pad against the rock face to generate a third force to augment and stabilize forces from the first and second stabilizer cylinders in opposition to a reaction from the anchor bolt.

3. A feed frame assembly as claimed in claim 2 in which the frame assembly is also adapted to be used in a position where a second rock face is disposed adjacent the rear end of the feed frame assembly and generally facing the first rock face, the assembly including:

i. a fourth hollow longitudinal member extending between the front and rear members, ii. a fourth stabiliser cylinder fitted within the fourth member, the fourth cylinder cooperating with a fourth bearing pad at a rear end of the fourth member, the fourth cylinder being adapted to extend the fourth bearing pad rearwards from a retracted position to force the fourth pad against the second rock face, to apply a force in opposition to forces from the first, second and third stabilizer cylinders, so that, when an anchor bolt is not used, forces resulting from the extension of the first, second and third stabilizer cylinders are balanced in an equilibrium position by a force from the fourth stabilizer cylinder, thus positioning and holding the feed frame assembly rigidly between the first and second rock faces.

4. A feed frame assembly as claimed in claim 3 in which the attachment means in fitted adjacent a forward end of the fourth longitudinal member so that rearwards extension of the fourth stabilizer cylinder moves the attachment means rearwards.

5. A feed frame assembly as claimed in claim 1 wherein:

i. the second cylinder body has pulling dog lugs attached thereto, the lugs permitting attachment of a pulling dog to the second cylinder when the drill head is released from the second cylinder so that an axis of the pulling dog is aligned with the drill rod axis, so that actuation of the second cylinder moves the pulling dog between forward and rearward positions, thus permitting power feeding of a drill rod into, and power withdrawal from a bore hole when the pulling dog grips the drill rod, and in which the assembly further includes:

ii. valve means cooperating with the hydraulic power means to divert hydraulic fluid from the first feed cylinder to the second feed cylinder so that the second feed cylinder receives both fluid flows, thus permitting rapid actuation of the second feed cylinder to increase speed of feeding and withdrawal of the drill rod.

6. A feed frame assembly as claimed in claim 1 further including:

i. a head swing-out cylinder having one end thereof connected to a rigid portion of the feed frame assembly and an opposite end thereof adapted to cooperate releasably with means connected to the drill head, so that when the drill head is released from the second feed cylinder, the head swing-out cylinder can be connected to the drill head so that actuation of the head swing-out cylinder swings the drill head axis away from the drill rod axis to provide clearance.

7. A feed frame assembly as claimed in claim 1 further including a drill rod lock mounted adjacent the front end member, the drill rod lock having:

i. a rod lock housing straddling the drill rod axis so that drill rods pass therethrough, the housing being adapted to be connected to the front end member, ii. a pair of spaced parallel pivot pins journalled in the housing and disposed on opposite sides of the drill rod axis in planes normal to the drill rod axis, iii. a jaw holder secured to each pivot pin, each jaw holder having inner ends disposed closely to the drill rod axis and between the drill axis and the respective pivot pin, iv. a jaw member hinged to each inner end of each jaw holder so that the jaw member can rotate relative to the respective jaw holder about a jaw axis parallel to the pivot pins, the jaw member of one jaw holder being disposed oppositely to the jaw member of the opposite holder and spaced equally from the drill rod axis, v. spring means cooperating with the jaw members to swing the jaw members inwards towards each other, so that the jaw members can grip a drill rod positioned between the jaw members, vi. an actuating cylinder cooperating with each pivot pin to swing the jaw holders with the pivot pins, the actuating cylinder being positioned so that extension of the cylinder rotates the pivot pins to swing the jaw members in opposition to the spring means to release the drill rod gripped by the jaw members, so that force available to open the jaws is greater than force available to close the jaws.

8. A feed frame assembly as claimed in claim 7 in which the drill rod lock is further characterized by:

i. each jaw member being hinged on a respective jaw pin to a respective jaw holder, and each jaw member having an inner surface serving as a jaw face to contact the drill rod retained therein, and an outer surface disposed generally diametrically opposite to the inner surface, the outer surface having a convex partially cylindrical bearing surface concentric with the jaw pin, ii. the rod lock housing having a pair of spaced bearing seats disposed remotely from the rod lock axis, each bearing seat being adjacent a respective pivot pin and having a concave partially cylindrical surface concentric with the adjacent pivot pin, iii. each jaw holder having a concave partially cylindrical bearing seat concentric with the respective jaw pin and complementary to and adapted to support the convex bearing surface of the respective jaw member thus serving as an inner bearing; and each jaw holder further including a convex partially cylindrical bearing surface concentric with the respective pivot pin and positioned generally diametrically opposite to the respective jaw holder bearing seat, each convex jaw holder bearing surface being complementary to and adapted to be supported in the respective bearing seat of the rod lock housing, thus serving as an outer bearing, so that most of the reaction from the gripping force of the jaws on the drill rod is transferred from the jaw member across the inner bearing into the jaw holder, and then from the jaw holder across the outer bearing to the drill rod lock housing, thus reducing loads on the jaw pins and the pivot pins.

9. A feed frame assembly as claimed in claim 1 in which the second drill head mounting means includes:

i. an arcuate lug secured to and extending outwards from the drill head, ii. shoulder means complementary to the arcuate lug provided on the second cylinder body, and in which the connecting means includes:

iii. a releasable latch means to hold the arcuate lug in engagement with the shoulder means, so that the arcuate lug is secured rigidly to the second cylinder body ensuring concurrent movement of both feed cylinders.

10. A drill supporting apparatus for supporting and feeding a drill head having a drill head axis, the drill head being adapted to grip and rotate a drill rod about a drill rod axis aligned with the drill head axis, the drill supporting apparatus including:

i. a swivel base including first and second mutually rotatable swivel base members, the base members being journalled for rotation about a first axis thereof, the second base member being adapted to be mounted on a supporting device, ii. a frame bed secured to the first base member, the frame bed having track means disposed parallel to the drill rod axis, iii. a feed frame assembly carried on the frame bed, the feed frame assembly including:

a. spaced front and rear end members, b. first and second double rod hydraulic feed cylinders extending between the end members, the feed cylinders including: first and second piston rods disposed parallel to the rod axis and having opposite ends, each end being secured to an adjacent end member, the piston rods having double-acting pistons; first and second hydraulic cylinder bodies cooperating with the respective piston rods and pistons, the bodies adapted to communicate with a hydraulic power means for moving the cylinder bodies along the respective rods, the first cylinder body being journalled for rotation on the first piston rod; and first and second drill head mounting means adapted to secure generally opposite sides of the drill head to the first and second cylinder bodies, the first mounting means rigidly connecting the drill head to the first cylinder body to permit swinging of the drill head with the first cylinder body about the first piston rod, the first piston rod thus serving as a hinge pin to permit the drill head axis to be swung away from the drill rod axis to a non-aligned position to provide clearance, the second drill head mounting means including a connecting means adapted to secure releasably the drill head to the second cylinder body so that the drill head and drill rod axes are aligned, so that mutual actuation of the feed cylinders moves the drill head along the piston rods;

c. longitudinal means rigidly connecting the end members and including a slide means extending between the end members and cooperating with the track means to permit sliding of the feed frame assembly relative to the frame bed;

the supporting apparatus further including:

iv. a positioning cylinder extending between the frame bed and the feed frame assembly so that actuation of the positioning cylinder slides the feed frame assembly relative to the frame bed to permit positioning of the feed assembly relative to a rock face, v. locking means adjacent the track means to lock the feed frame assembly rigidly to the frame bed when the feed frame is positioned in a desired location.

11. A drill supporting apparatus as claimed in claim 10 in which the supporting device includes:

i. a skid base adapted to be supported generally horizontally, ii. a support arm having an inner end hinged to the skid base for swinging of the support arm about a lower hinge axis, and an outer end hinged to the second base member for swinging of the swivel base about an upper hinge axis, the hinge axes being parallel, iii. a jacking cylinder extending between the skid base and the support arm for swinging the support arm about the lower hinge axis, iv. a tilting cylinder cooperating with the swivel base and the support arm so that actuation of the tilting cylinder swings the swivel base and with it the feed frame assembly, about the upper axis.

12. A drill supporting apparatus as claimed in claim 9 in which the frame assembly is adapted to be used in conjunction with an anchor bolt in a first rock face adjacent the front end of the assembly, the feed frame assembly including:

i. an attachment means fitted adjacent the front end of the assembly, the attachment means being adapted to be coupled to the anchor bolt, and in which the longitudinal means includes:

ii. laterally spaced first and second hollow longitudinal members disposed parallel to the drill rod axis, iii. first and second stabilizer cylinders fitted within the first and second longitudinal members respectively, the cylinders cooperating with bearing pads at front ends thereof and being adapted to extend the respective bearing pads forward from a retracted position to force the pads against the rock face, thus tending to force the feed frame assembly away from the rock face, the frame assembly further including:

iv. a third hollow longitudinal member extending rearwards from the front end member and disposed parallel to the drill rod axis and on a side of the drill rod axis generally remote from the first and second longitudinal members, so that the three longitudinal members are spaced generally symmetrically about the rod axis, the third longitudinal member also including:

v. a third stabilizer cylinder fitted within the third longitudinal member and cooperating with a third bearing pad at a front end thereof, the third cylinder being adapted to extend the third bearing pad forward from a retracted position to force the third bearing pad against the rock face to generate a third force to augment and stabilize forces from the first and second stabilizer cylinders in opposition to a reaction from the anchor bolt.

* * * * *